US006910707B1

(12) United States Patent
Lyng

(10) Patent No.: US 6,910,707 B1
(45) Date of Patent: Jun. 28, 2005

(54) ROTATABLE SNOWBOARD BOOT BINDING ANCHOR APPARATUS

(76) Inventor: William E. Lyng, 13 Division St., Whitehall, NY (US) 12887

( * ) Notice: Subject to any disclaimer, the term of this patent is extended or adjusted under 35 U.S.C. 154(b) by 0 days.

(21) Appl. No.: 10/778,094

(22) Filed: Feb. 17, 2004

(51) Int. Cl.[7] ..... A63C 9/082

(52) U.S. Cl. ..... 280/618; 280/607; 280/14.22; 280/14.24

(58) Field of Search ..... 280/607, 617, 280/618, 620, 629, 623, 14.21, 14.24, 14.22, 280/14.23, 626, 632, 633, 634

(56) References Cited

U.S. PATENT DOCUMENTS

| | | | | |
|---|---|---|---|---|
| 5,354,088 | A * | 10/1994 | Vetter et al. | 280/618 |
| 5,577,755 | A * | 11/1996 | Metzger et al. | 280/607 |
| 5,762,358 | A | 6/1998 | Hale | |
| 5,765,853 | A | 6/1998 | Erb | |
| 5,791,678 | A | 8/1998 | Perlman | |
| 5,897,128 | A * | 4/1999 | McKenzie et al. | 280/607 |
| 6,022,041 | A | 2/2000 | Dailey et al. | |
| 6,062,584 | A * | 5/2000 | Sabol | 280/607 |
| 6,102,430 | A | 8/2000 | Reynolds | |
| 6,203,051 | B1 | 3/2001 | Sabol | |
| 6,206,402 | B1 * | 3/2001 | Tanaka | 280/607 |
| 6,234,494 | B1 * | 5/2001 | Gien | 280/14.24 |
| 6,290,243 | B1 | 9/2001 | Beran | |
| 6,302,411 | B1 * | 10/2001 | Huffman et al. | 280/14.24 |
| 6,318,749 | B1 | 11/2001 | Eglitis et al. | |
| 6,450,511 | B1 | 9/2002 | LaVoy | |
| 6,467,794 | B1 * | 10/2002 | De France | 280/607 |
| 6,467,795 | B1 * | 10/2002 | Hirayama et al. | 280/14.24 |
| 6,520,531 | B1 * | 2/2003 | Gien | 280/618 |
| 6,575,489 | B1 | 6/2003 | White | |
| 2003/0057679 | A1 | 3/2003 | Pollmiller | |
| 2003/0090072 | A1 | 5/2003 | Cole, III | |
| 2003/0230870 | A1 | 12/2003 | Sabol | |

* cited by examiner

*Primary Examiner*—Hau Phan
(74) *Attorney, Agent, or Firm*—John J. Welch, Jr., Esq.

(57) ABSTRACT

A rotatable snowboard boot binding anchor apparatus consisting of a base disc component with peripherally positioned screw holes and centrally positioned circularly and elliptically shaped anchoring holes for anchoring the apparatus to a snowboard and reservoirs located therein for receipt of a pair of latch plates, which base disc component supports, resting upon it, a rotatable top plate with a spring loaded pull-pin located in housing affixed to the top side of the top plate which pull-pin is insertable into holes within the latch plates and which top plate with centrally located circularly and elliptically shaped mounting holes to facilitate, together with mounting insert units press fitted to such centrally located mounting holes, an anchoring to the top plate, of a boot binding; together with a top locking ring with peripherally positioned screw holes, to, with screws, be affixed to the base disc component while circumscribing and accordingly holding the top plate, with a pull-strap component leashable to a person's leg being attached to a ring affixed atop the pull-pin.

10 Claims, 9 Drawing Sheets

ROTATABLE SNOWBOARD BOOT BINDING ANCHOR APPARATUS

CROSS REFERENCES TO PRIOR OR PARENT APPLICATIONS

Figure 1:
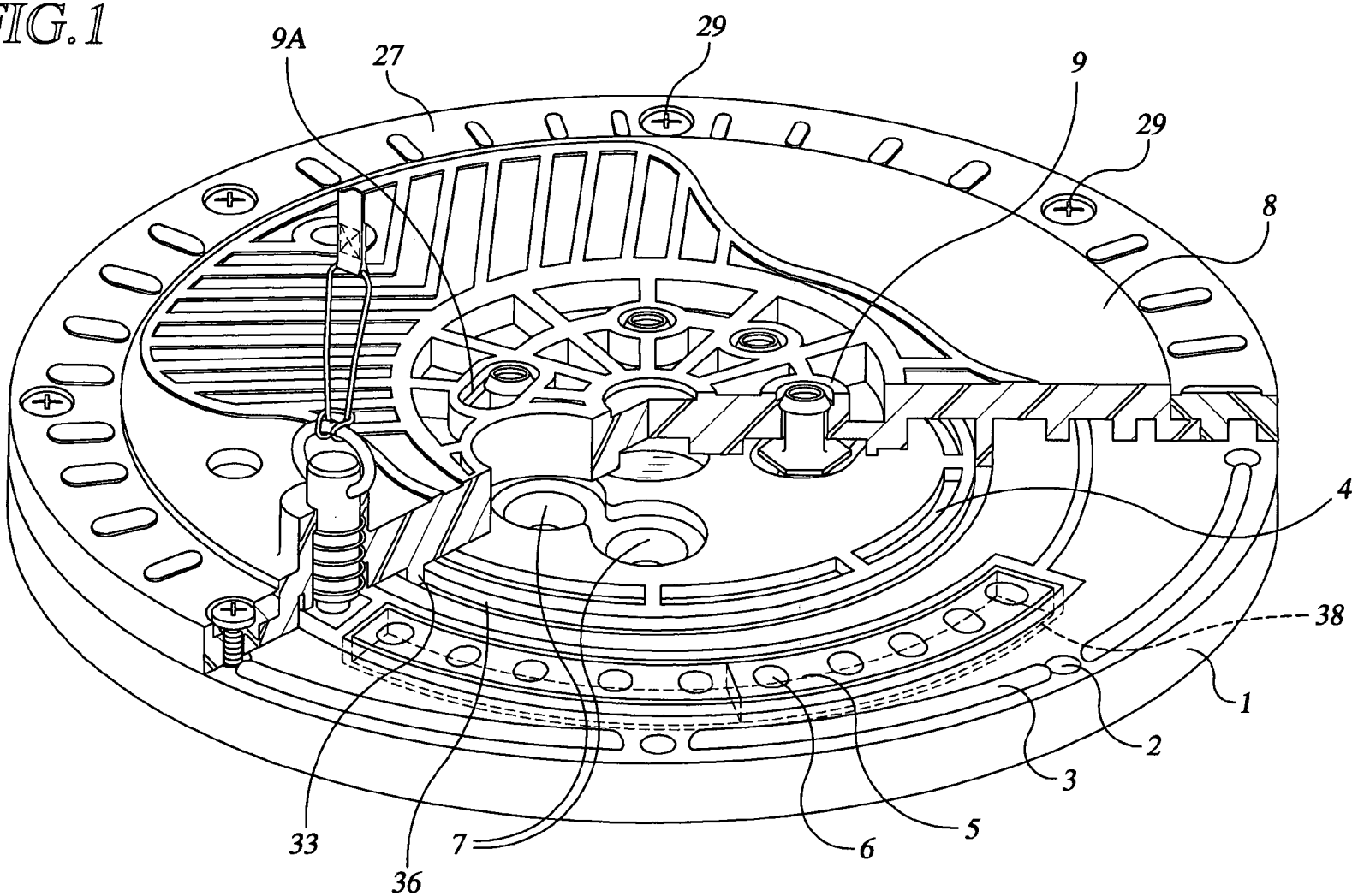

There are no prior or parent applications to which the instant application relates.

FEDERALLY SPONSORED RESEARCH AND DEVELOPMENT

There is no federally sponsored research and development to which the instant invention relates.

BACKGROUND OF THE INVENTION

1. Field of the Invention

The instant invention is one of such devices as serves to anchor snowboard boot bindings to snowboards.

2. Prior Art

The art set forth in the accompanying Informational Art Statement does not anticipate the instant invention.

SUMMARY OF THE INVENTION

1. A Brief Description of the Invention:

The instant invention consists of a base disc component that is anchored via anchoring holes centrally located therein to a snowboard. There is a hollowed out center portion of this base disc into which is fitted a pair of latch plates each having a configuration akin to the arc of a circle and each having a plurality of holes in each. Positionally adjacent to and just above the base disc is a rotatable two-tier top plate equipped with a spring loaded pull-pin component. The circumference of the top plate is less than that of the base disc component. A top locking ring fits flush about the top plate and the top locking ring with a top locking ring circumference being equal to the circumference of the base disc component, is affixed to the base disc component by way of a plurality of peripherally placed screws inserted through peripherally placed holes in the top locking ring and similar holes in the base disc component with such screws being fitted to nuts below the base disc component. Mounting holes in the center of the top plate facilitate mounting, via hollowed out internally threaded mounting insert units press fitted to such holes, of a snowboard boot binding unit to the top plate. The pull-pin fits into any one of the holes in either one of the latch plates. A pull-strap component is attached at one end thereof to elastic looping affixable to a ring affixed to the pull-pin and is attached at another end portion thereof to a prong-strap attached to a circular sheath fitted to the leg of a snowboarder. By pulling upwards on the pull-strap, a snowboarder can thereby release the pull-pin component from its position in a latch plate hole and in so do doing, then rotate the position of his or her foot fast within a snowboot in a binding through an angle either while walking about at the base of a slope or while snowboarding down a slope in and within packed down snow, then soft powder, then packed down snow and so forth. Such pulling upwards affects removal of the pin from one of the holes in one of the latch plates. Releasing tension on the strap after rotating a foot through an angle causes the pull-pin to fit back into a different latch plate hole thereby fixing the foot at an angle away from the previously fixed foot position.

2. Objects of the Invention:

Snowboarders at the base of a slope perambulating about to get i.e., to a lift line or to a warming hut but equipped with most currently available boot binding anchoring devices affixed to the snowboards are required to release their back feet from their boards and then propel themselves forward with their front feet locked at the same angles with reference to the fronts of the boards as when such snowboarders would have been previously snowboarding down a slope. Consequently, as is the case with respect to most of the current art regarding the anchoring of front foot and boot bindings to a snowboard, virtually all of such persons are accordingly required to awkwardly propel themselves forward at the base of a slope by way of pushing off with their back feet while, as was noted above, their front feet remain positioned at the angle such front feet would have been positioned at while such persons would have been snowboarding down the slope with reference to the longitudinal central axes of symmetry of such boards. The instant invention permits, by way of a pulling upward on the pull-strap component of the invention, a board user to then rotate a front foot through an angle so that the longitudinal central axis of symmetry of the front foot would then be parallel to the longitudinal central axes of symmetry of the board and that of the propelling back foot as well through propulsion at the base of a slope. This feature makes it much easier for board users to perambulate about at the base of a slope without having to otherwise endure undue stress to be placed upon their knees and ankles. Moreover, the pull-pin and pull-strap features of the invention readily enable users to rotate their front feet through angles also when descending such a slope in order to instantly accommodate maximally appropriate interaction with soft powder, then packed down snow, etc., all found on the slope. Moreover, the latch plates positioned as they are within the body of the base disc permit rotation of the front foot through an angle from a "left" sided position or from a "right" sided position. Hence, whether snowboarders descend slopes facing left or facing right as initially anchored to their boards, the instant invention remains truly viable for all them in respect of the foregoing. Finally, and most importantly, by virtue of the pluralities of centrally placed circularly and elliptically shaped holes in the base disc and top plate components of the instant invention, the instant invention can readily function vis-à-vis virtually all various types of snowboards and boot bindings, and; uniquely serve to ensure that a snowboarder's first or front foot is always centered above the center point in and within either triangularly or rectangularly positioned anchoring holes on any snowboard or anchoring pegs on any boot binding unit. This centering assurance serves to guarantee that, whenever a snowboarder seeks to angulate his or her front foot off to the side and out of alignment with the longitudinal central axis of symmetry of the board, that person's toe will never be more off the board than that person's heel and vice versa. In this way maximal board control from vantage points of both utility and safety is ensured whenever a user seeks to manipulate through either packed down snow or soft powder while riding down a slope.

In conclusion, for all of the foregoing reasons, the instant invention is truly new, useful and unique.

A DESCRIPTION OF THE DRAWINGS

1. FIG. 1 is a cutaway view of the top locking ring top plate and base disc components of the instant invention.

Figure 2:
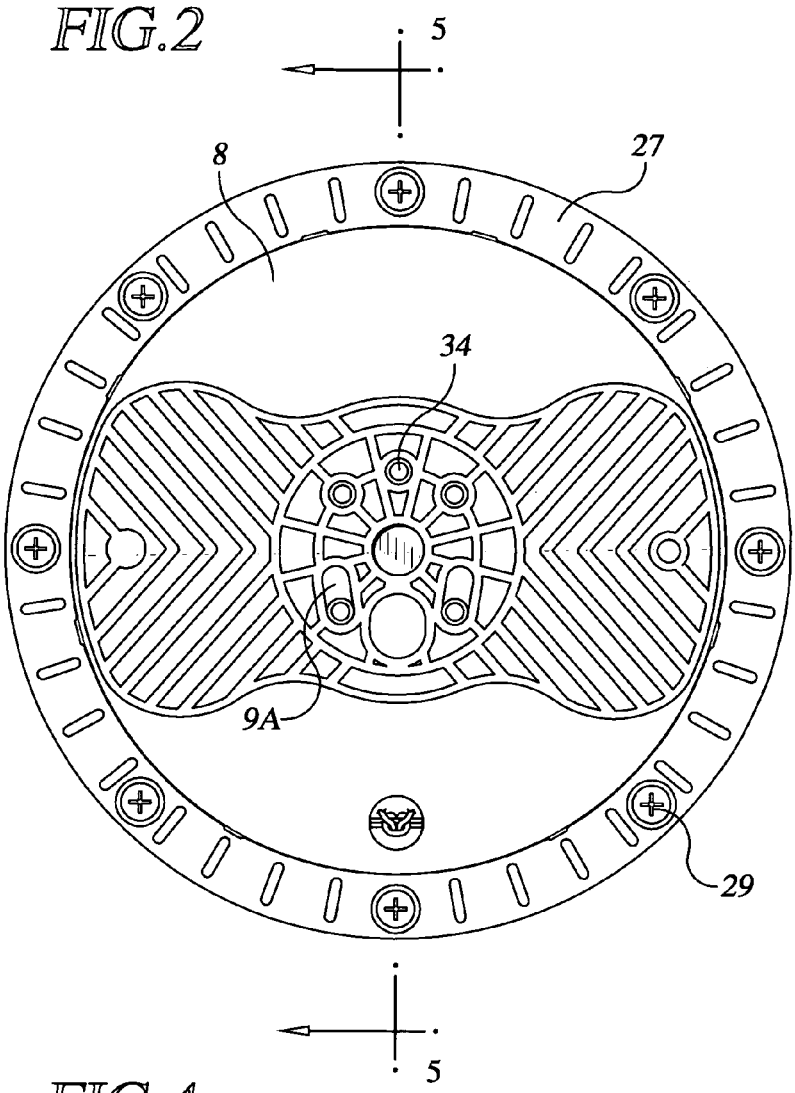

2. FIG. 2 is a top plan view of the rotatable two-tier top plate fitted within the top locking ring of the instant invention.

Figure 3:
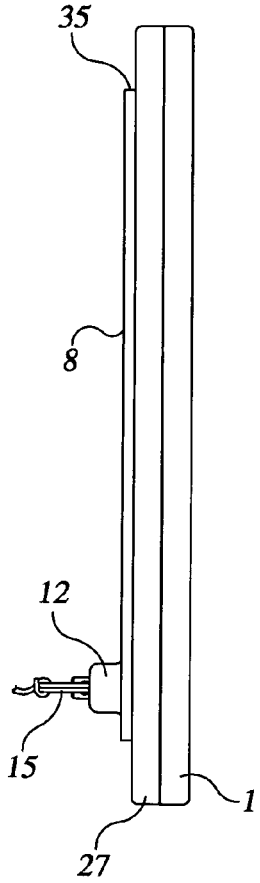

3. FIG. 3 is a lateral plan view of the instant invention.

Figure 4:
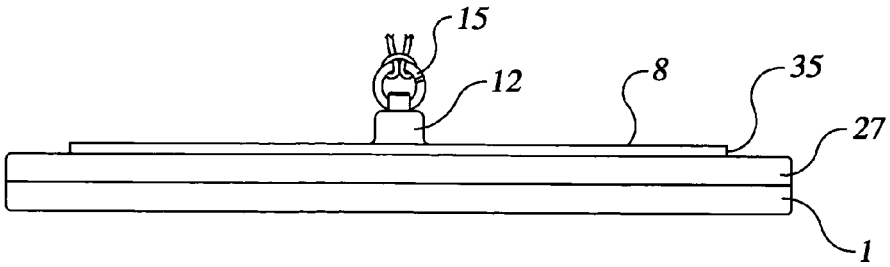

4. FIG. 4 is a frontal plan view of the instant invention.

Figure 5:
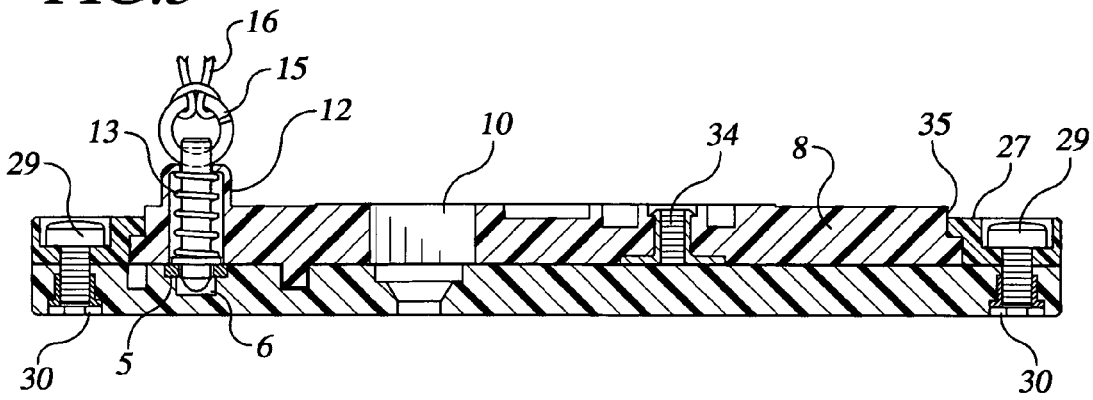

5. FIG. 5 is a cross-sectional view from a lateral side of the instant invention.

Figure 6:
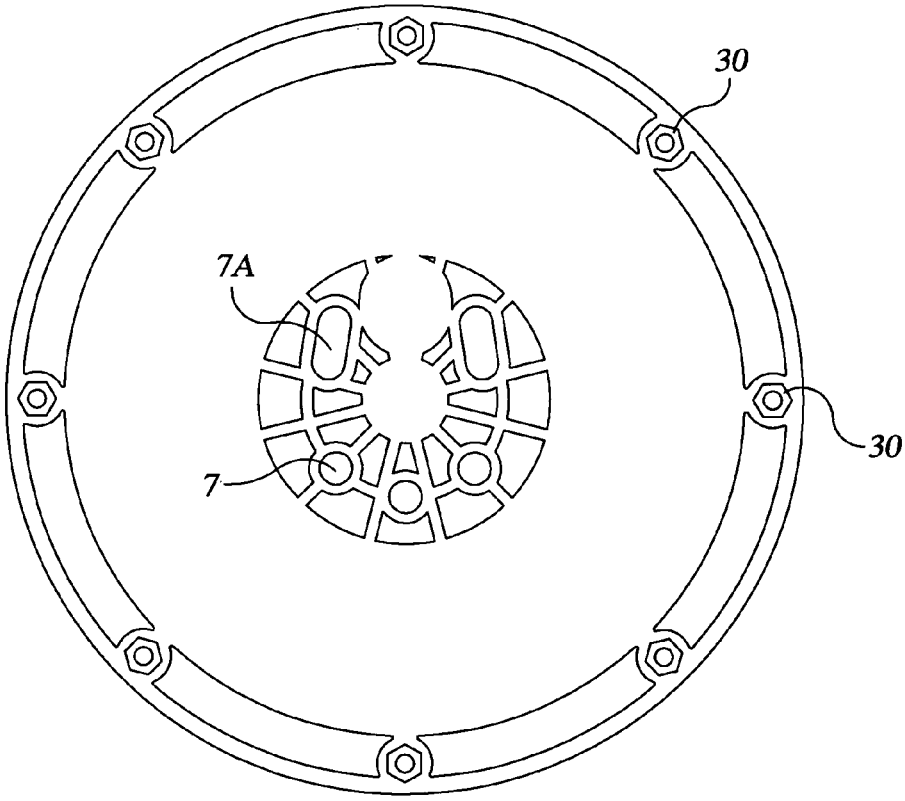

6. FIG. 6 is a bottom plan view of the base disc component of the instant invention.

Figure 7:
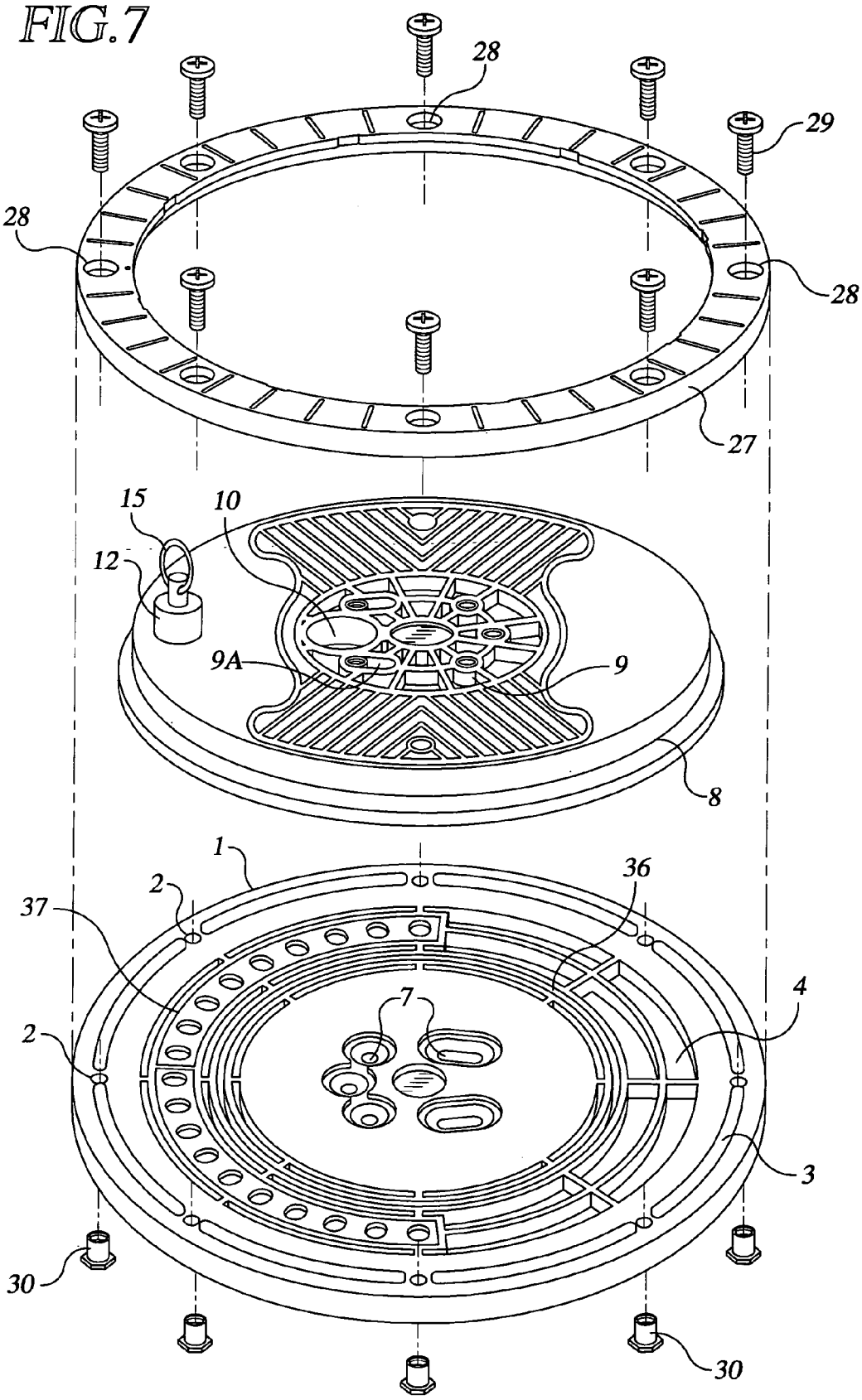

7. FIG. 7 is an exploded view of the top locking ring, rotatable two-tier top plate and base disc components of the instant invention.

Figure 8:
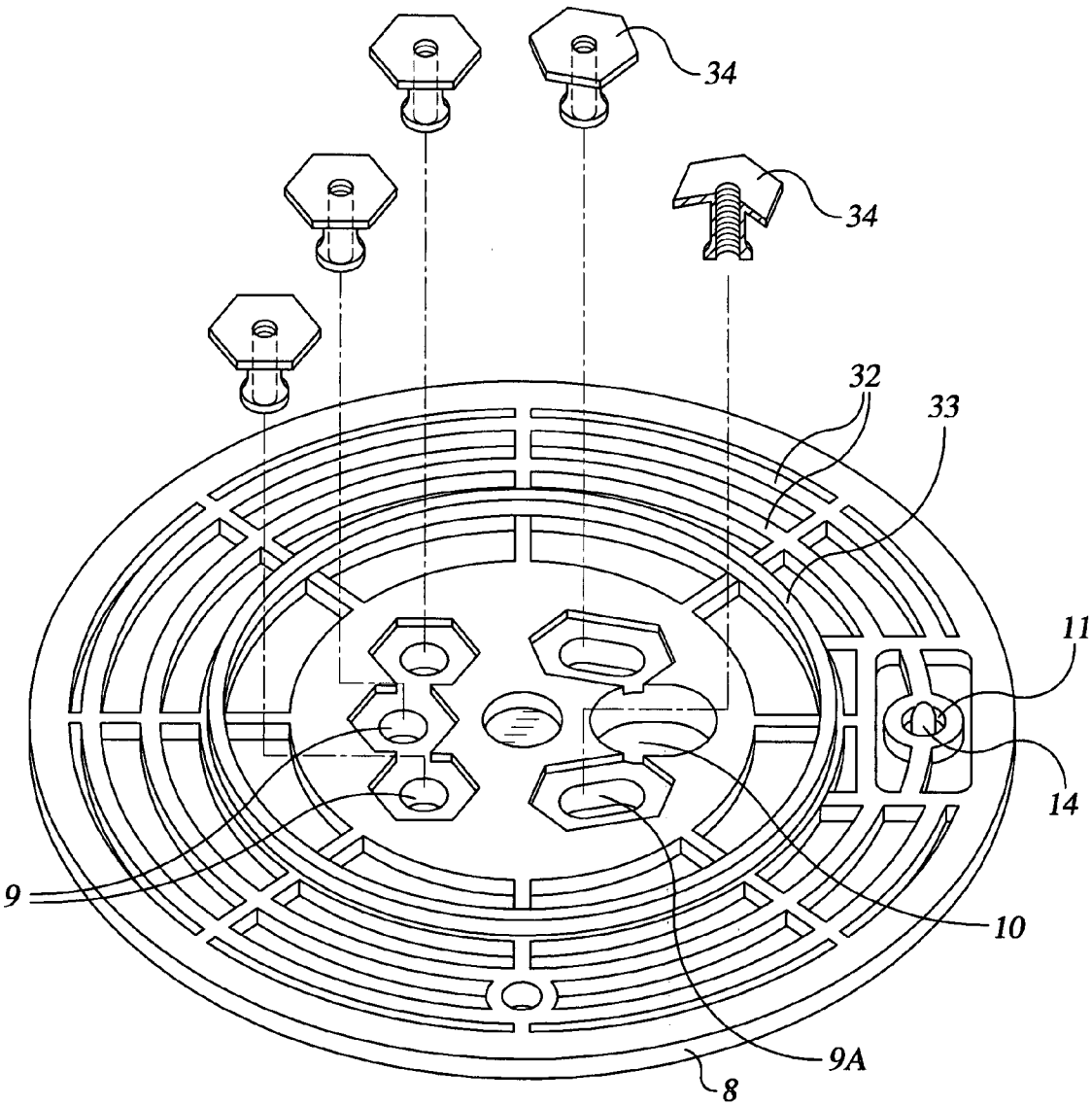

8. FIG. 8 is an isolated bottom plan view of the rotatable two-tier top plate components and mounting insert component of the instant invention.

Figure 9:
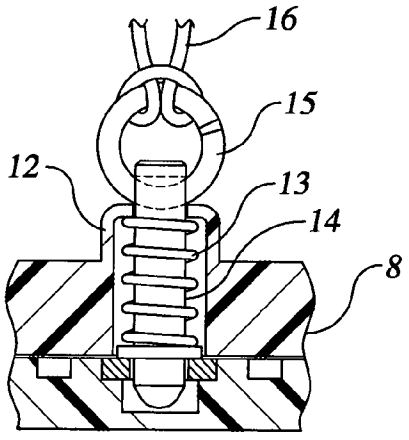

9. FIG. 9 is a cross sectional view of the spring loaded pull-pin component of the instant invention.

Figure 10:
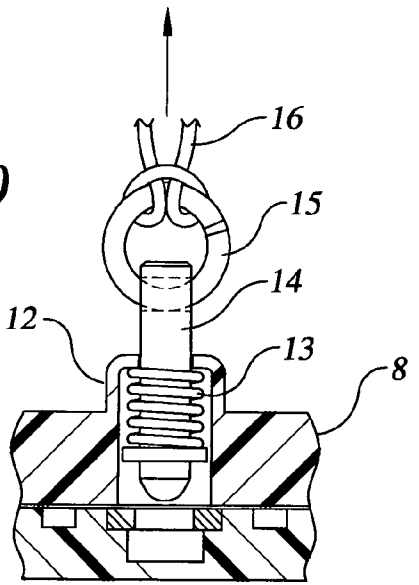

10. FIG. 10 is a cross sectional view of the spring loaded pull-pin component of the instant invention under tension.

Figure 11:
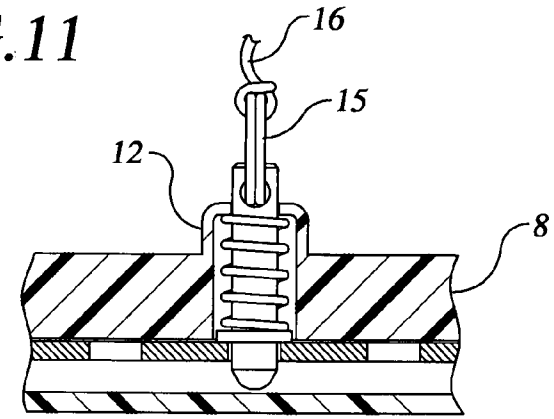

11. FIG. 11 is a view of what is seen in FIG. 10 but rotated through an angle of 90°.

Figure 12:
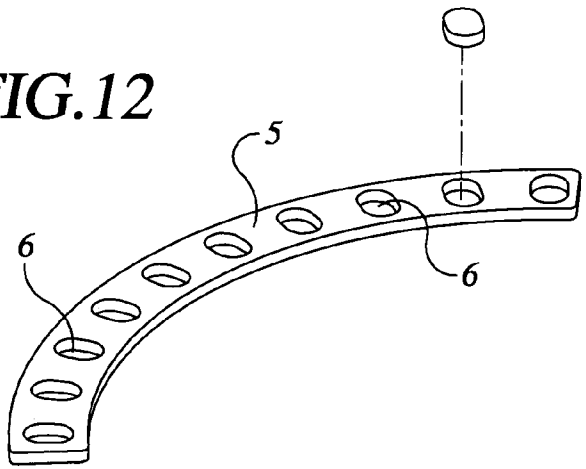

12. FIG. 12 is a view of one of the equivalent latching plate components of the instant invention.

Figure 13C:
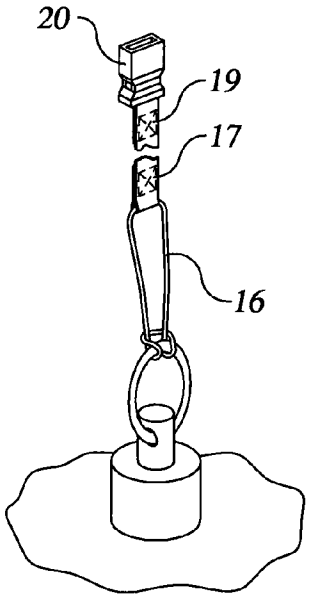
Figure 13A:
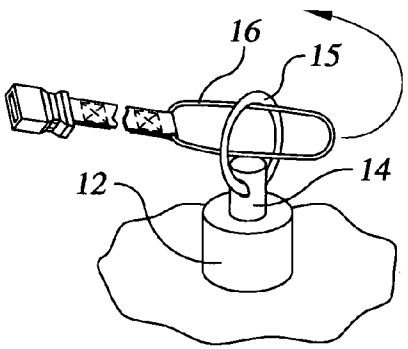

13A. FIG. 13A illustrates insertion of an elastic base loop portion of a pull-strap into the ring portion of the pull-pin component of the instant invention.

Figure 13B:
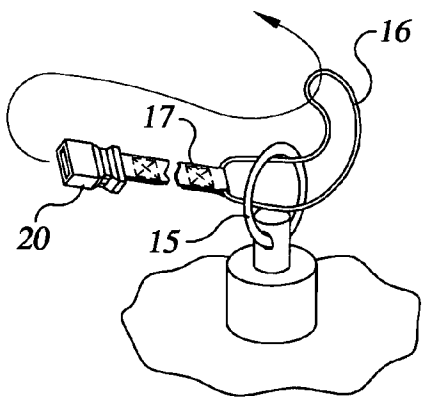

13B. FIG. 13B illustrates the manner of commencement of tying the elastic base loop portion of the pull-strap to the ring portion of the pull-pin component.

13C. FIG. 13C illustrates a fully tied base loop to the ring portion of the pull-pin component.

Figure 14:
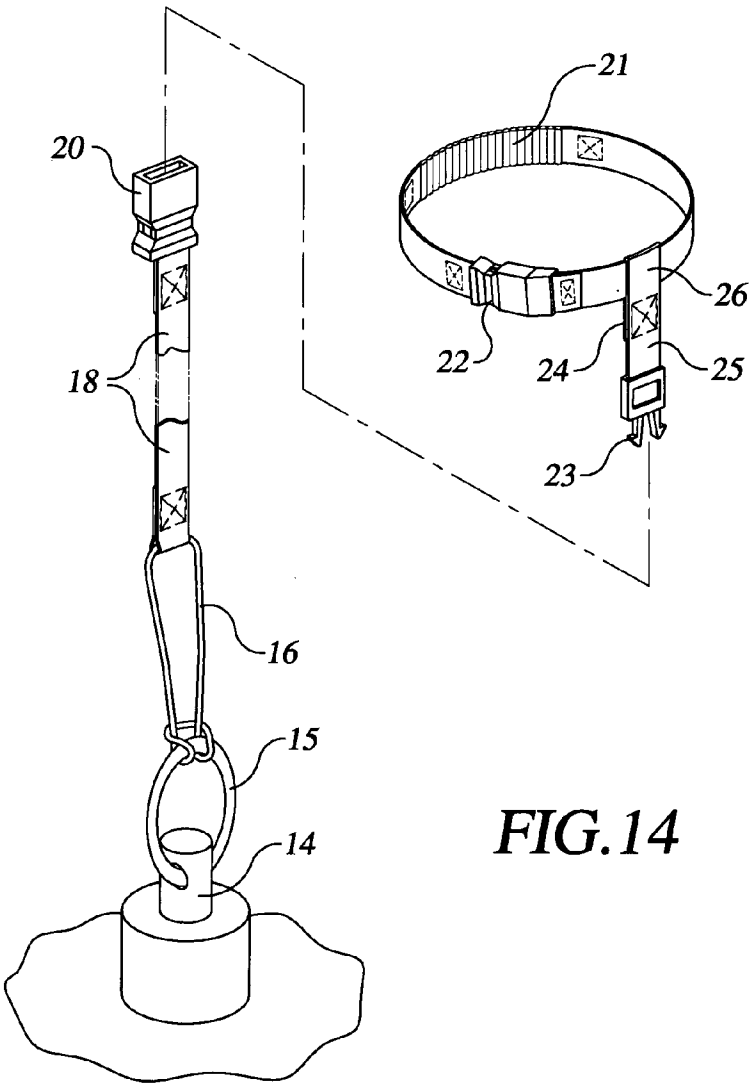

14. FIG. 14 illustrates the manner in which a pull strap is ultimately affixed via a prong-strap to a circular thigh sheath.

Figure 15:
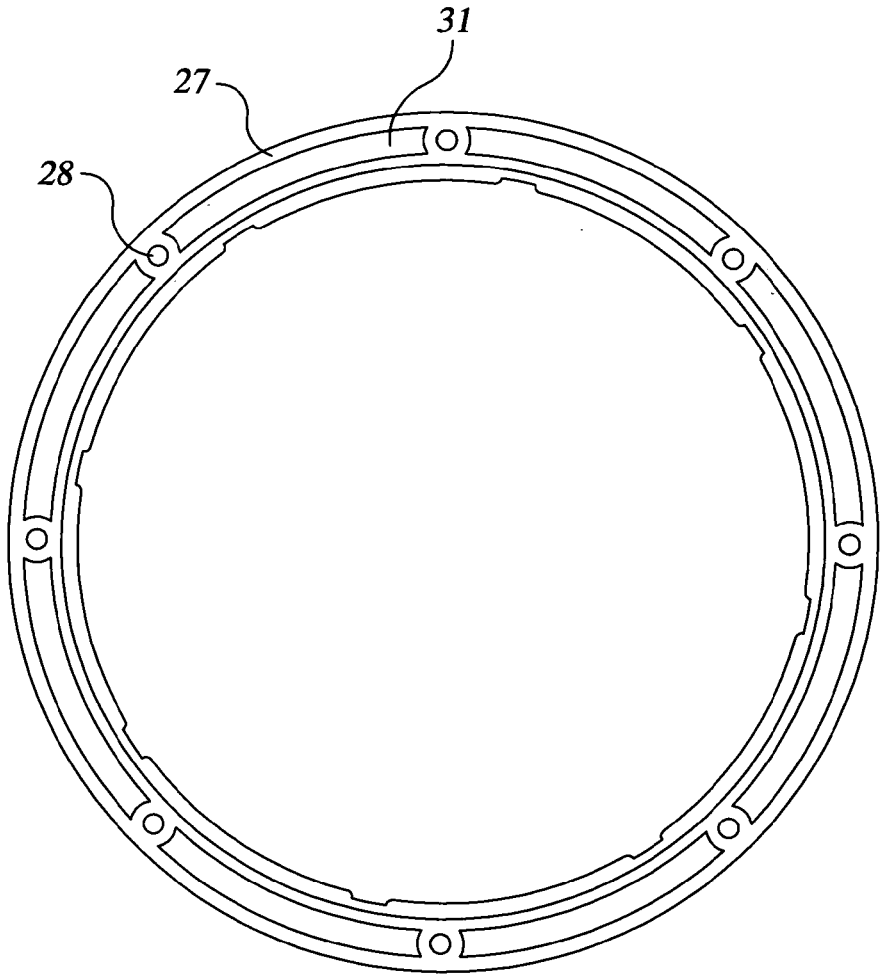

15. FIG. 15 is a bottom plan view of the top locking ring.

Figure 16:
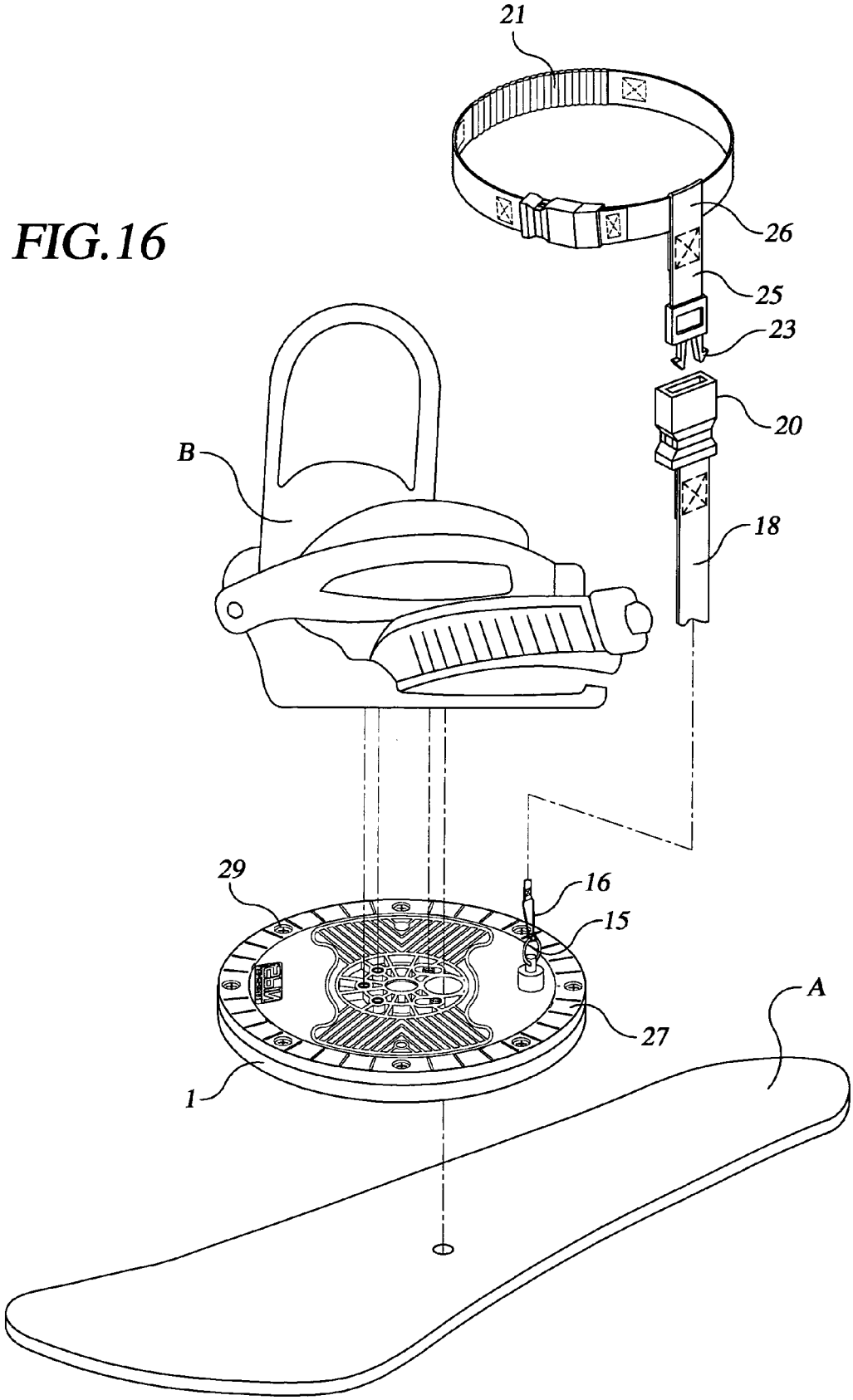

16. FIG. 16 is an exploded view of a snowboard and boot binding unit in apposition to the instant invention.

A DESCRIPTION OF THE PREFERRED EMBODIMENTS

The instant invention, a rotatable snowboard boot binding anchor apparatus is shown in exploded view in FIG. 16. In FIG. 16, one notes a snowboard A to which the invention is anchorable and a snow boot binding B which is anchorable to the invention as well. One assembles the invention to a snowboard by way of affixing the base disc component 1 of the invention shown in FIGS. 1, 2, 3 and 7 to a snowboard A in the following manner. Base disc component 1 is characterized by the presence of base disc anchoring holes 7 and elliptically shaped base disc anchoring holes 7A which enable a person to screw base disc component 1 down fast to any and all varieties of snowboard A, some of which have four rectangularly separated holes for receipt of a boot binding B anchoring unit and some of which have only 3 triangularly separated holes for receipt of such a unit. Elliptically shaped anchoring holes 7A facilitate anchoring to those boards A containing anchoring holes positioned further apart within some of such boards A than others. Such holes also facilitate, as earlier noted above, assurance of the centering of a snowboarder's front foot upon the longitudinal central axis of symmetry of the board and upon a point within equal distance from all four or all three anchoring holes within the board in use, whichever type of board, to wit, one with four or one with three of such holes, such as may have been of particular preference to the snowboarder utilizing it. Base disc component 1 is also characterized by the presence of base disc ribbing 3 and peripheral disc screw holes 2 together with base disc reservoirs 4 seen in FIGS. 1 and 7. Latch plates 5 marked by the presence of latch plate holes 6 are depicted in FIGS. 1 and 12. Rotatable two-tier top plate 8 rests atop component 1 as can be seen with resort to FIG. 5 and appreciated with resort to FIG. 1. Top plate 8 has therein, centrally positioned as per FIG. 8 a multiplicity of top plate mounting holes 9 and elliptically shaped top plate anchoring holes 9A which serve to receive mounting insert units 34 which are affixable to the screw pegs of boot binding units B. Mounting insert units 34 that are hollowed out and internally threaded are press fit into top plate mounting holes 9 and 9A and the hexagonally shaped head portions of mounting insert units 34 fit within holes 9 and 9A which are recessed and amenable to taut receipt of such hexagonally shaped head portions to thereby make for enhanced stability of the anchoring and ultimate affixation of a boot binding unit B to rotatable two-tier top plate 8. Holes 9 and 9A fitted each with a mounting insert unit 34 all serve to accommodate boot binding units B that are designed with either three triangularly positioned threaded screw pegs, or four rectangularly positioned threaded screw pegs with holes 9A serving to moreover accommodate those units B with such threaded screw pegs variably positioned from one another. Elliptically shaped holes 9A by way of providing means to adjust positioning of mounting inserts 34 like holes 7A mentioned above all serve to facilitate the symmetrical centering earlier noted as respects optimally symmetrical overhanging of toes and a heel over a board when a foot is turned sidewise at an angle to the lie of the longitudinal central axis of symmetry of the board. This very unique feature of the instant invention facilitates such true foot centering upon all variant forms of snowboard regardless of the type of boot binding unit utilized and this feature perhaps more than any other serves to enhance the uniqueness and true utility of the instant invention. Access hole 10 within rotatable two-tier top plate 8 shown also in FIG. 8 serves to make it very convenient to anchor a fully assembled rotatable snowboard boot binding apparatus via base disc anchoring holes 7 and/or 7A to a snowboard A without a need to first disassemble the apparatus. Rotatable two-tier top plate 8 rests atop base disc component 1 and is held within top locking ring 27 all as is seen in FIG. 1. The apparatus is held together by way of peripheral disc screws 29 passed through peripherally located screw holes 28 shown in FIG. 1 and then again in FIG. 15 and peripheral base disc screw holes 2 and received by nut units 30 all as can be appreciated with resort to FIGS. 2, 6 and 7. A height difference 35 as between top plate 8 and top locking ring 27 upon full assembly of the apparatus is shown in FIGS. 3 and 4. This height differential 35 provides a measure of clearance as respects mounted boot binding units B with reference to the outer perimeter of the apparatus during the course of rotation of top plate 8 during use of the apparatus fully mounted to a snowboard A to thereby provide for freer rotatability of the two-tier top plate 8. Also, base disc ribbing 3 seen in FIG. 1 fits within top locking ring reservoirs 31 seen in FIG. 15 to make for greatly enhanced stability of the apparatus upon full assembly to a snowboard A and boot binding unit B and in use by a person. Concentric ribbing 33 in the bottom side of top plate 8 as seen in FIG. 8 fits into concentric inner walling 36 within the topside of base disc component 1 as seen in FIG. 7 upon full assembly of the apparatus for use. This feature serves to greatly stabilize rotation of top plate 8 within top locking ring 27 about base disc component 1 during use of the fully assembled apparatus mounted to a snowboard A. Outer ribbing 32 in the bottom side of rotatable two-tier top plate 8 as seen in FIG. 8 serves to firmly hold latch plates 5 in place atop specially configured arcs of latch plate ribbing 37 within base disc component 1 as seen in FIGS. 1 and 7 and below ribbing 32 upon full assembly of the apparatus for use and in use mounted to a snowboard A. Specially configured latch plate ribbing 37 is characterized by shelving 38 jutting medially inward from the inner wallings of ribbing 37 into the reservoir space between the wallings so as to thereby enable each of latch plates 5 to rest securely thereupon within the inner perimeters of such ribbing 37 upon such full assembly of the apparatus. All of the foregoing features serve to promote safety as well as efficacy of use of the apparatus mounted to a snowboard A. Moreover, such ribbing especially ribbing 32 greatly enhances shear strength of the apparatus so as to greatly militate against any possibility of sidewise breakage during use. FIGS. 9, 10 and 11 depict one of the very unique and distinguishing features of the apparatus. Pull-pin housing 12 being a part of top plate 8 houses spring 13 located about pull-pin 14 also therein which pull-pin 14 juts out of a hole in the top surface of housing 12 and to which there is affixed a pull-pin ring 15. Affixed to ring 15 is a pull-strap elastic loop 16. Loop 16 is elastic rather than static, a safety feature to facilitate against inadvertent pull-pin 14 release by a person atop a snowboard A equipped with the apparatus. FIGS. 13A, 13B and 13C and 14 serve to illustrate the manner in which the apparatus anchored to a board A and binding unit B is also tethered to a person fitted to binding unit B atop a board A. A first end 17 of pull-strap 18 is affixed to elastic loop 16 per FIG. 13A. A second end thereof 19 is affixed to locking socket means 20. Circular sheath 21 via sheath locking means 22 is held about the thigh of a person. Prong-strap 24 is affixed at a second end 26 thereof to sheath 21 and affixed to a first end 25 thereof is locking prongs means 23. Full affixation of the apparatus to a person is accomplished by locking sheath 21 via means 22 about a person's thigh and then locking prong-strap 24 via means 23 inserted into means 20 to pull-strap 18. When a person using the apparatus is about to walk about at the base of a slope, that person simply pulls on strap 18 that places tension on loop 16 to thereby via ring 15 lift pin 14 within housing 12 from a rest position within hole 11 shown in FIG. 8 and one of latch plate holes 6 to a position above the level of latch plate 5 thereby enabling that person to rotate that person's front foot within binding unit B via rotatable two-tier top plate 8 through an angle such that that foot is then pointed along the longitudinal central axis of symmetry of snowboard A rather than at an angle away from the longitudinal central axis of symmetry of snowboard A such as would be the case during use of the apparatus while riding snowboard A down a slope. In this way when a person releases his or her back foot from the snowboard A at the bottom of the slope to propel himself or herself about on the way to or from perhaps a coffee shop or perhaps back to a lift line, it becomes much easier and relatively safer for that person to so get about when that person's front foot is pointing straight ahead along the longitudinal central axis of symmetry of snowboard A rather than remaining at an angle to this axis of snowboard A while so moving about. Stabilization of the front foot in such a position now along the longitudinal central axis of symmetry of snowboard A is accomplished by releasing tension on pull-strap 18 thereof, thereby causing pull-pin 14 to drop back into a different latch plate hole 6 and hole 11 once again subsequent to the rotation of two-tier top plate 8 through the angle desired so as to then effectuate such stabilized front foot positioning within boot binding unit B affixed to top plate 8 now along the longitudinal central axis of symmetry of snowboard A. One might ask, why not just remove both feet from snowboard A and boot binding B instead of just one foot while getting around at the base of a slope. The answer to such a question would be that the leashing feature of the apparatus combining sheath 21, prong-strap 24 and pull-strap 18 with loop 16 and ring 15 is meant to also serve to eliminate the possibility of a runaway snowboard event subsequent to a fall during use on a slope. Also, it is much more convenient for a snowboarder to be able to skate, as it were, as noted above, about the base of a slope rather than to be required to instead carry a snowboard A about while so perambulating about the base of a slope. In addition to the foregoing features of the apparatus, pull-pin 14 can be released to facilitate rotation of a person's front foot through an angle perforce of rotation of two-tier top plate 8 as noted above indeed during use of the apparatus while proceeding down a slope. Release of pin 14 and reinsertion of pin 14 just subject to desired rotation, enables a person using the apparatus coming down a slope to adjust for varying snow conditions on the slope, to wit, conditions varying from hard packed or semi-icy snow to relatively deep soft powdery snow. For example, a person will ride with his or her front foot aligned with the longitudinal central axis of symmetry of snowboard A to facilitate toe-heel maneuvering over packed powder and then ride with his or her front foot aligned virtually perpendicular to the longitudinal central axis of symmetry of snowboard A to facilitate side to side rocking and a pushing of soft dry powder under snowboard A on that portion of a slope marked by the presence of such dry powdery snow. The unique feature of ready pull-pin 14 release capability, top plate 8 rotation and ready reinsertability of pull-pin 14 all during use on a slope in and of itself renders the apparatus extremely convenient and useful. This feature of the invention is markedly unique. Also, the reason for equipping the apparatus with two latch plates 5 as shown above is so that boot binding units B can be either initially affixed pointing leftwardly atop a snowboard A as is the case with most people who prefer to ride a snowboard A left foot forward or instead initially affixed pointing rightwardly atop a snowboard A as is the case with some people who prefer to ride a snowboard A with right foot forward depending upon a person's particular preferences in terms of how he or she would want to stand atop and ride such a snowboard A during use coming down a slope. In such respects, rotation of top plate 8 upon release of pull-pin 14 for persons riding left foot forward would be from left back to center, center being the line coterminus with the longitudinal central axis of symmetry of snowboard A or would be from right back to such center as would be the case for persons riding right foot forward. It should also be noted that latch plates 5 can be customized to have only i.e., 3 or so latch plate holes 6 within them so as to enable adjustment to only those specific holes as a particular snowboarder may want therein. The pull-pin 14, pull-ring 15, elastic loop 16 and pull strap 18 combination forming an integral aspect of the apparatus serves to make possible two-tier top plate 8 rotation during use, a feature indeed unique to the apparatus alone, since, a person atop a snowboard A equipped with the apparatus fully assembled thereto as noted above can effectuate top plate 8 rotation simply by pulling up and then releasing pull-strap 18 post rotation as opposed to having to, as would be the case with any other device anywhere similar to the apparatus while affixed to a snowboard A; otherwise, somehow be able to bend and curl down to pull a release pin in a direction parallel to the lie of the snowboard A in order to achieve desired rotation of foot position upon the board during use, an obviously impossible undertaking.

In conclusion, respectfully submitted, for the reasons cited above, the instant invention as described above is not merely new useful and unique but is indeed veritably revolutionary in the art of snowboard boot binding anchoring devices.

What is claimed is:

1. A rotatable snowboard boot binding anchor apparatus, comprising:

a. a base disc component;

b. peripheral base disc screwholes about a periphery of said base disc component;

c. outer ribbing about said periphery of said base disc component;

d. a plurality of base disc reservoirs concentrically cut into a topside of said base disc component;

e. an equivalent pair of latch plates;

f. a plurality of latch plate holes in each of said latch plates;

g. a plurality of base disc anchoring holes within a center portion of said base disc component;

h. a rotatable two-tier top plate;

i. a plurality of top plate mounting holes within a center portion of said rotatable two-tier top plate;

j. a top plate access hole located within said center portion of said rotatable two-tier top plate;

k. pull-pin housing affixed near an outer edge of and atop said rotatable two-tier top plate;

l. a pull-pin access hole located in said rotatable two tier top plate directly below said pull-pin housing;

m. a spring loaded pull-pin;

n. a tension spring positioned about said pull-pin;

o. said spring loaded pull-pin and tension spring being housed with said pull-pin housing;

p. a pull-pin ring affixed to said pull-pin;

q. a pull-strap elastic loop attachable to said pull-pin ring;

r. a pull-strap attached at a first end thereof to said pull-strap elastic loop;

s. first locking means affixed to a second end of said pull-strap;

t. a circular sheath unit;

u. means for locking one end of said circular sheath to a second end thereof;

v. second locking means;

w. a prong-strap;

x. said second locking means being affixed to a first end of said prong-strap;

y. said circular sheath unit being affixed to a second end of said prong-strap;

z. a top locking ring;

aa. a plurality of peripherally located screw holes in said top locking ring;

bb. a plurality of peripherally located reservoirs in said top locking ring for receipt of said outer ribbing about said periphery of said base disc component;

cc. a plurality of peripheral disc screws;

dd. a plurality of nut units affixable to said screws upon placement of said peripheral disc screws through said peripherally located screw holes for purposes of holding said top locking ring to said base disc component and concomitantly holding said two tier top plate within said top locking ring rotatably atop said base disc component;

ee. concentric ribbing in a bottom side of said rotatable two tier top plate;

ff. concentric inner walling in a top side of said base disc component for receipt of said concentric ribbing upon full assembly of said rotatable snowboard boot binding anchor apparatus;

gg. outer ribbing in said bottom side of said rotatable two tier top plate;

hh. specially configured arcs of latch plate ribbing within said top side of said base disc component;

ii. latch plate shelving affixed to inner walling of said arcs of latch plate ribbing and jutting medially therefrom into reservoir spacing as between each of said arcs of latch plate ribbing with said latch plates seated upon said shelving, and;

jj. a plurality of hollowed out internally threaded mounting insert units, each one being press fitted within one of said top plate anchoring holes with those having been fitted to those of said anchoring holes as are elliptical in shape being slideable therein from end to end.

2. The rotatable snowboard boot binding anchor apparatus of claim 1, whereby, a plurality of said top plate anchoring holes are elliptically shaped.

3. The rotatable snowboard boot binding anchor apparatus of claim 1, whereby, said mounting insert units have hexagonally shaped heads.

4. The rotatable snowboard boot binding anchor apparatus of claim 1, whereby, a topside of said rotatable two tier top plate is higher than a topside of said top locking ring when said snowboard boot binding anchor apparatus is fully assembled.

5. The rotatable snowboard boot binding anchor apparatus of claim 1, whereby, a plurality of said base disc component holes are elliptically shaped.

6. A rotatable snowboard boot binding anchor apparatus, comprising:

a. a base disc component;

b. an equivalent pair of latch plates;

c. a plurality of latch plate holes in each of said latch plates;

d. a plurality of base disc anchoring holes within a center portion of said base disc component;

e. a rotatable two-tier top plate;

f. a plurality of top plate mounting holes within a center portion of said rotatable two-tier top plate;

g. a top plate access hole located within said center portion of said rotatable two-tier top plate;

h. pull-pin housing affixed near an outer edge of and atop said rotatable two-tier top plate;

i. a pull-pin access hole located in said rotatable two tier top plate directly below said pull-pin housing;

j. a spring loaded pull-pin;

k. a tension spring positioned about said pull-pin;

l. said spring loaded pull-pin and tension spring being housed with said pull-pin housing;

m. a pull-pin ring affixed to said pull-pin;

n. a pull-strap elastic loop attachable to said pull-pin ring;

o. a pull-strap attached at a first end thereof to said pull-strap elastic loop;

p. first locking means affixed to a second end of said pull-strap;

q. a circular sheath unit;

r. means for locking one end of said circular sheath to a second end thereof;

s. second locking means;

t. a prong-strap;

u. said second locking means being affixed to a first end of said prong-strap;

v. said circular sheath unit being affixed to a second end of said prong-strap;

w. a top locking ring;

x. affixation means for fastening said base disc component to said two tier top plate and said two tier top plate to said top locking ring;

y. specially configured arcs of latch plate ribbing within said top side of said base disc component;

z. latch plate shelving affixed to inner walling of said arcs of latch plate ribbing and jutting medially therefrom into reservoir spacing as between each of said arcs of latch plate ribbing with said latch plates seated upon said shelving, and;

aa. a plurality of hollowed out internally threaded mounting insert units, each one being press fitted within one of said top plate anchoring holes with those having been fitted to those of said anchoring holes as are elliptical in shape being slideable therein from end to end.

7. The rotatable snowboard boot binding anchor apparatus of claim 6, whereby, a plurality of said top plate anchoring holes are elliptically shaped.

8. The rotatable snowboard boot binding anchor apparatus of claim 6, whereby, said mounting insert units have hexagonally shaped heads.

9. The rotatable snowboard boot binding anchor apparatus of claim 6, whereby, a topside of said rotatable two tier top plate is higher than a topside of said top locking ring when said snowboard boot binding anchor apparatus is fully assembled.

10. The rotatable snowboard boot binding anchor apparatus of claim 6, whereby, a plurality of said base disc components are elliptically shaped.

* * * * *